US008607675B2

(12) United States Patent
Tsai et al.

(10) Patent No.: US 8,607,675 B2
(45) Date of Patent: Dec. 17, 2013

(54) TORQUE WRENCH

(76) Inventors: Ting-Ko Tsai, Taichung (TW); Chun-Wei Yang, Hang Zhou (CN); Zhe-Ping Zhang, Long you Township, Long you County (CN)

( * ) Notice: Subject to any disclaimer, the term of this patent is extended or adjusted under 35 U.S.C. 154(b) by 339 days.

(21) Appl. No.: 13/052,108

(22) Filed: Mar. 21, 2011

(65) Prior Publication Data

US 2012/0240735 A1 Sep. 27, 2012

(51) Int. Cl.
*B25B 23/142* (2006.01)

(52) U.S. Cl.
USPC ..... 81/478; 81/467; 81/468; 81/479

(58) Field of Classification Search
USPC ..... 81/467, 468, 478, 479
See application file for complete search history.

(56) References Cited

U.S. PATENT DOCUMENTS

| | | | | |
|---|---|---|---|---|
| 7,047,849 | B2 * | 5/2006 | Lai | 81/479 |
| 2005/0155469 | A1 * | 7/2005 | Li et al. | 81/479 |
| 2011/0154961 | A1 * | 6/2011 | Kan et al. | 81/478 |

* cited by examiner

*Primary Examiner* — Lee D Wilson
*Assistant Examiner* — Shantese McDonald

(57) ABSTRACT

A torque wrench includes a driving head, a hollow handle, compression unit, an adjustment unit, an index unit and a display unit. The driving head and the handle are pivotably connected to each other. The compression unit has a resilient member and an end piece which contacts the driving head. The adjustment unit adjusts the length of the resilient member to set the torque of the wrench. The index unit has a first index and a second index, both of which are moved with the movement of the adjustment unit. The movement of the first index is detected by the display unit and transferred into digits to display the value of the torque. The second index is cooperated with the marks of the scale member to display the value of the torque.

13 Claims, 16 Drawing Sheets

TORQUE WRENCH

FIELD OF THE INVENTION

The present invention relates to a torque wrench, and more particularly, to a torque wrench having electronic and mechanical display units.

BACKGROUND OF THE INVENTION

A conventional torque wrench is shown in U.S. Pat. No. 7,703,357 and generally includes a ratchet drive portion with an insertion member, a moment arm, a torque-adjustable rod, an in-place-rotatable handle, and a torque setting pointer. A hollow sleeve is fixed at a distal end of the moment arm by a fixing element. An internal toothed portion is formed in a stepped hole of the hollow sleeve and positioned adjacent to one side of the in-place-rotatable handle. The internal toothed portion is, in the normal state, engaged with an external toothed portion of the in-place-rotatable handle by means of an elastic element located between the in-place-rotatable handle and the hollow sleeve. The elastic element has one end abutting the stepped hole of the hollow sleeve. The torque-adjustable rod of a torque adjusting mechanism is driven by the in-place-rotatable handle for adjusting the torque value when the in-place-rotatable handle is pushed in the direction of the hollow sleeve so as to disengage the internal and external toothed portions from each other, thereby achieving an expected adjustment. After the adjustment, the external force is released and the internal and external toothed portions are automatically restored in an engaged and locked position of the normal state by means of the self-resilience of the elastic element. The drawbacks of the torque wrench is that when the in-place-rotatable handle is rotated to drive the torque-adjustable rod, the torque setting pointer is moved so that the pointer points a certain value mark to show the pre-set value of the torque. However, the pointer and the marks are so small and the user has to check carefully the relative positions therebetween and this is difficult especially when the illumination condition is poor.

Another conventional torque wrench is disclosed in U.S. Pat. No. 7,685,889 and generally includes a body portion positioned between a handle portion and a driving portion. The driving portion has a driving head to drive the object by pre-set torque. The handle portion has a certain length for the users to hold and a space is provided in the body portion for installing an electronic mechanism inside the body portion. The electronic mechanism has a volume for installing at least two electronic units therein and the electronic units are stacked to reduce the space required so that more electronic units can be installed to have multiple functions. Nevertheless, the electronic units need batteries to function and once the power from the batteries is gone, the display function fails.

The present invention intends to provide a torque wrench having electronic and mechanical display units.

SUMMARY OF THE INVENTION

The present invention relates to a torque wrench includes a driving head, a hollow handle, compression unit, an adjustment unit, an index unit and a display unit. The driving head and the handle are pivotably connected to each other. The compression unit has a resilient member and an end piece which contacts the driving head. The adjustment unit adjusts the length of the resilient member to set the torque of the wrench. The index unit has a first index and a second index, both of which are moved with the movement of the adjustment unit. The movement of the first index is detected by the display unit and transferred into digits to display the value of the torque. The second index is cooperated with the marks of the scale member to display the value of the torque.

The primary object of the present invention is to provide a torque wrench having electronic and mechanical display units to show the torque in two different ways.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
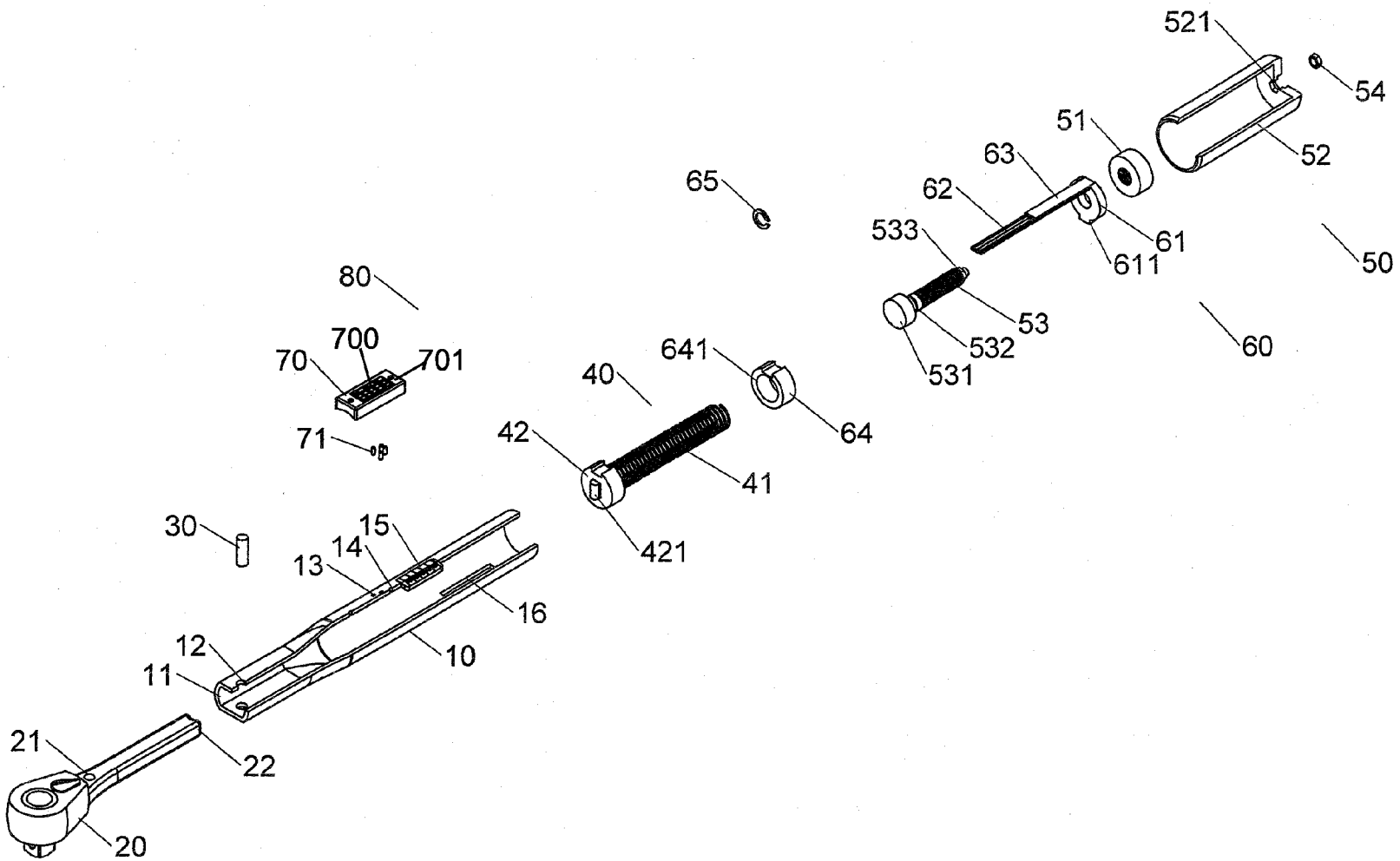
FIG. 1 is an exploded view to show the torque wrench of the present invention.
Figure 2:
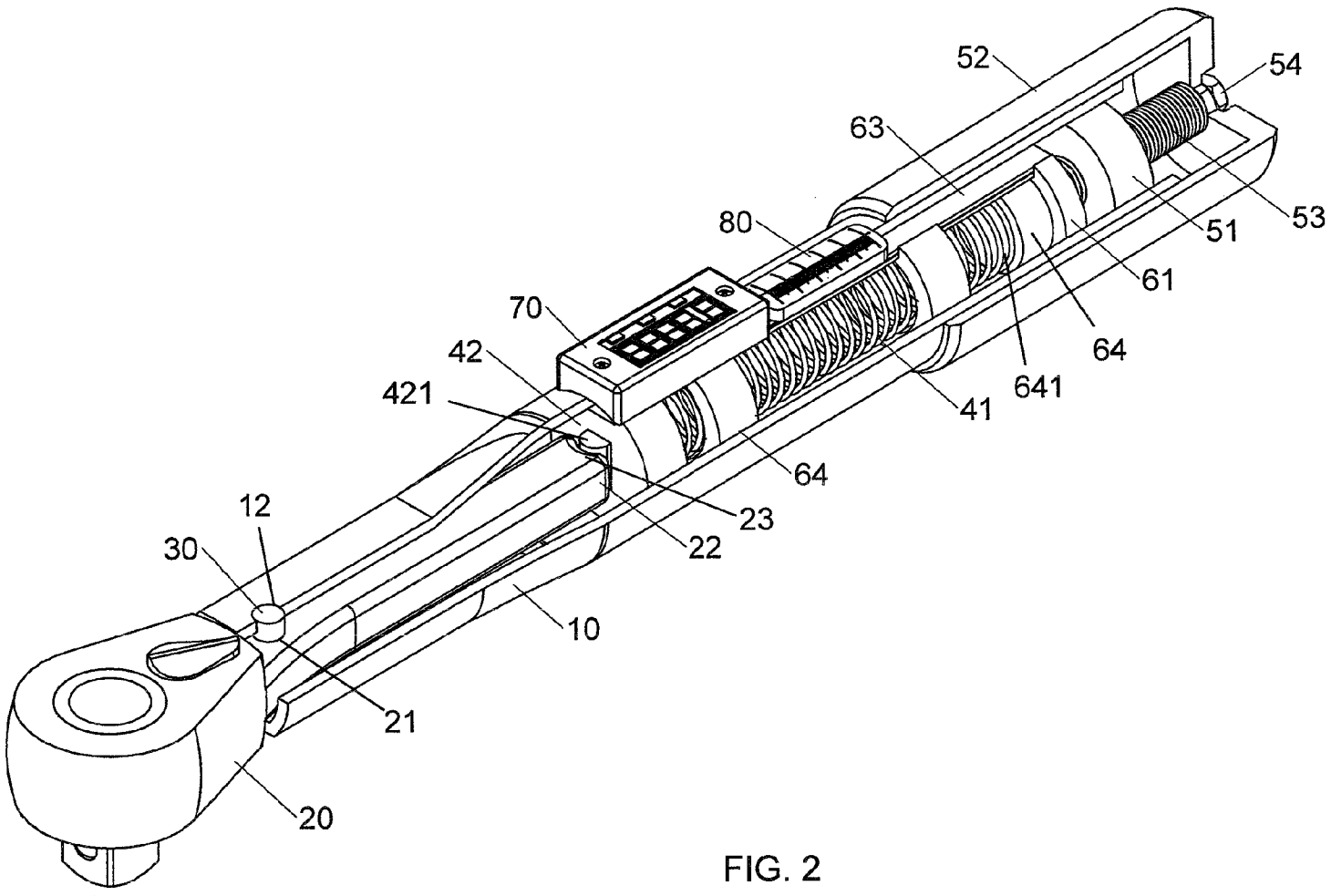
FIG. 2 is a perspective view to show the torque wrench of the present invention, wherein the handle and the outer tube are partially removed.
Figure 3:
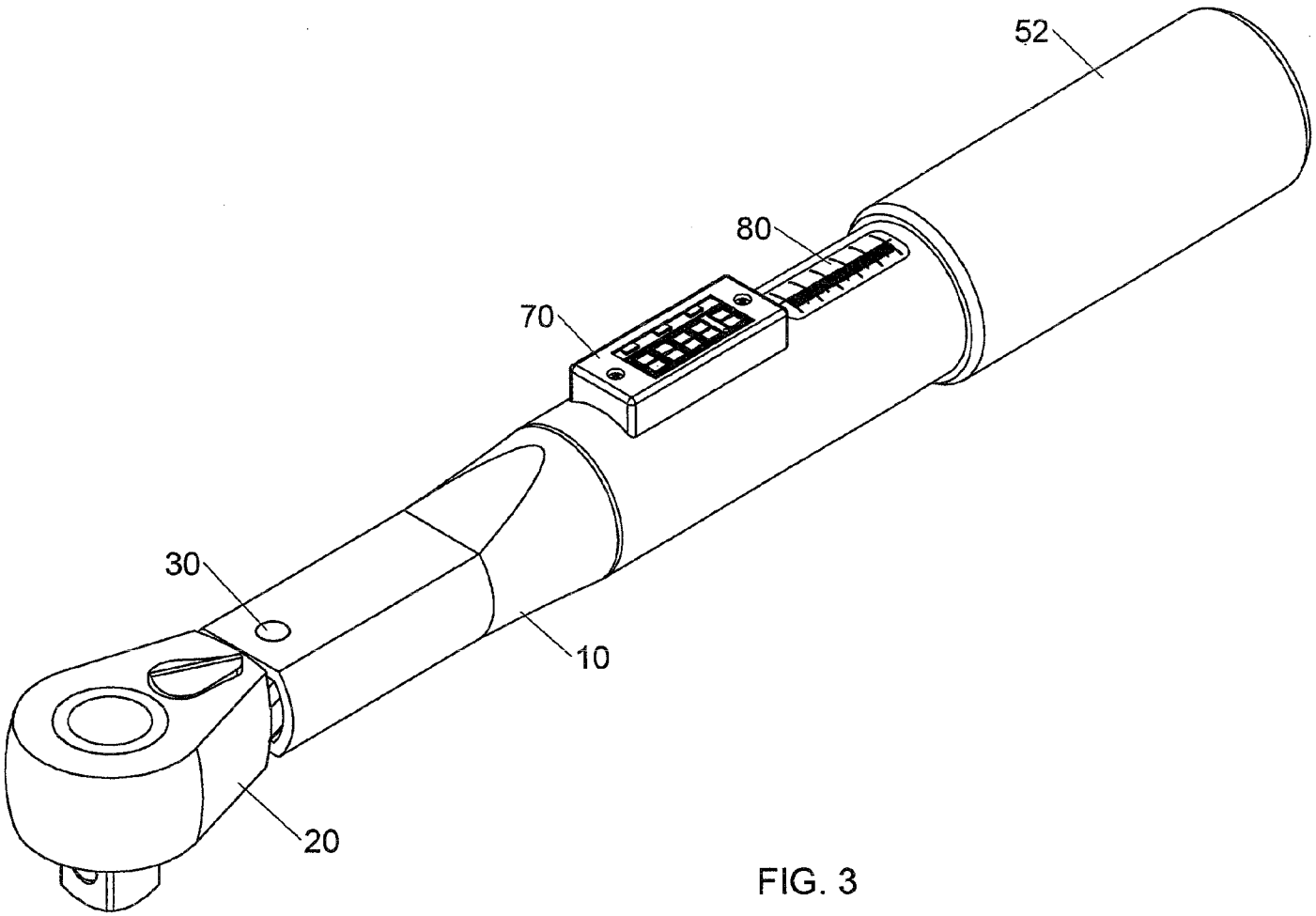
FIG. 3 is a perspective view to show the torque wrench of the present invention.
Figure 4:
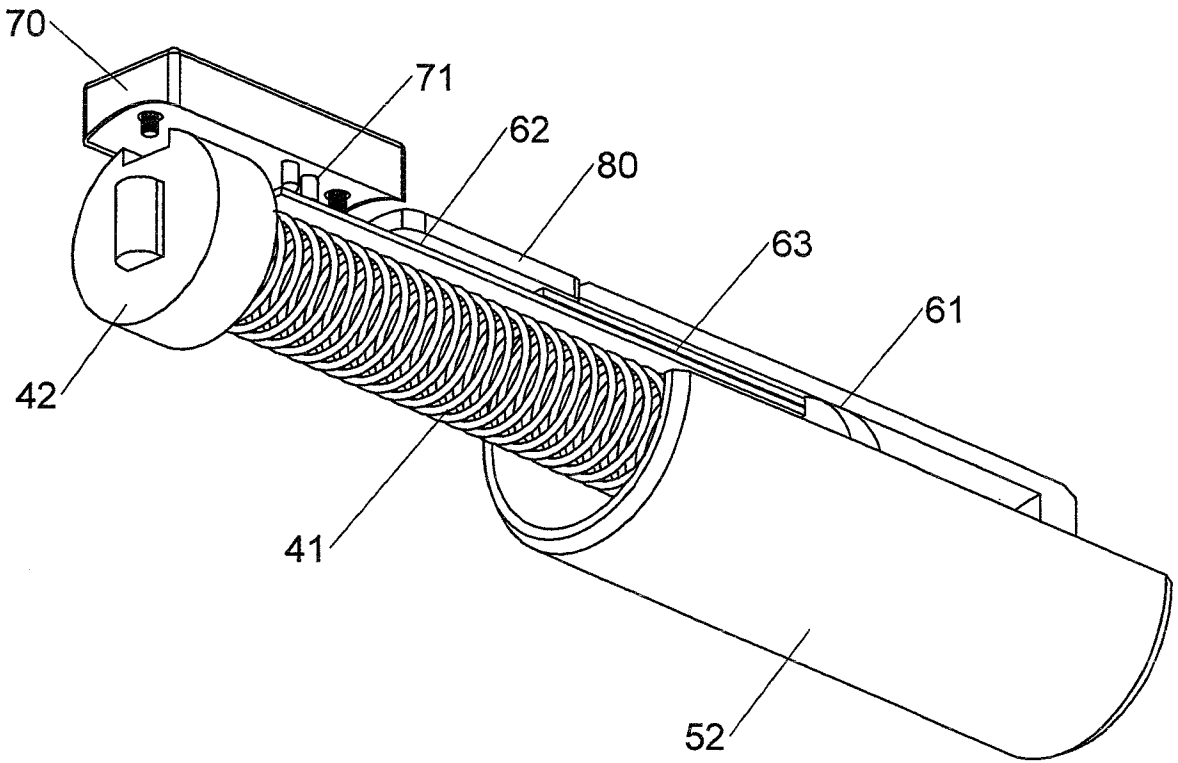
FIG. 4 is a perspective view to show the relative positions between the movement sensor and the first index, and between the scale member and the second index.
Figure 5:
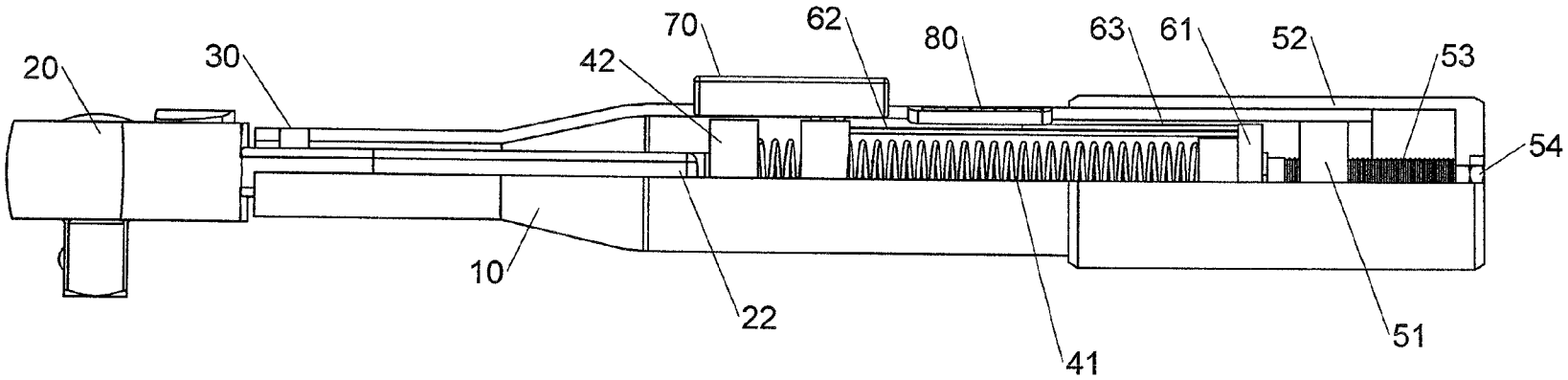
FIG. 5 shows the side view of the torque wrench of the present invention.
Figure 6:
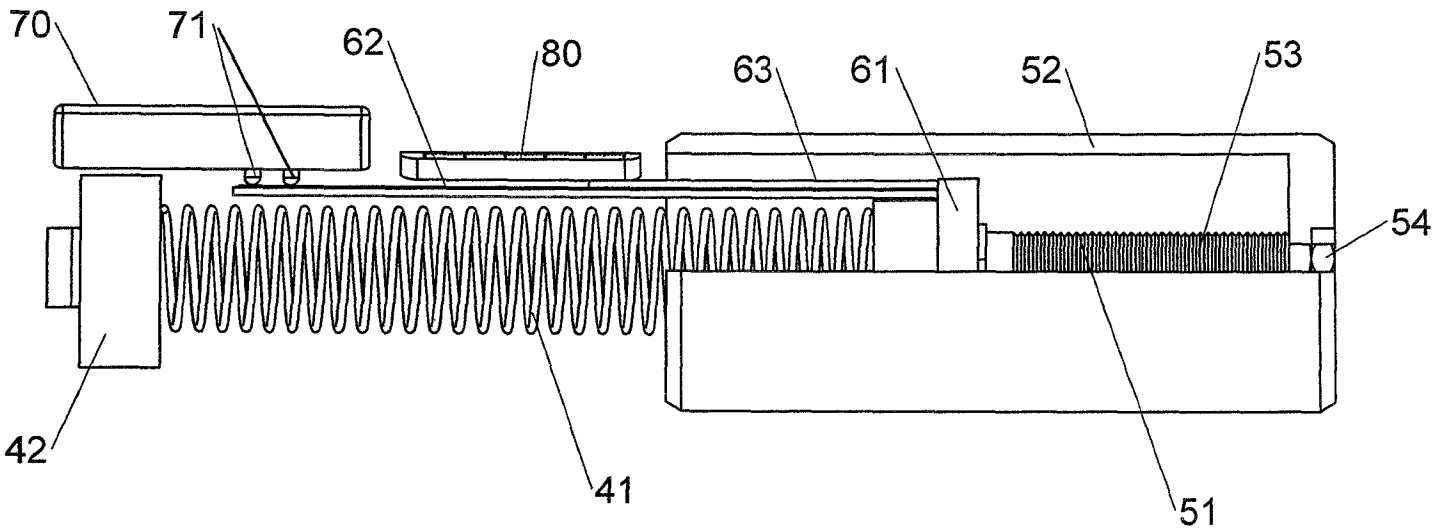
FIG. 6 is an enlarged view to show a part of the torque wrench in FIG. 5.

Referring to FIGS. 1-6, the torque wrench of the present invention comprises a hollow handle 10 having a space 11 defined therein. Four first recesses 13 and one second recess 15 are defined in the handle 10. A first hole 12 defined transversely through the handle 10 and an elongate guide slot 16 and at least two fixing holes 14 are also defined in the handle 10. The first hole 12, the four first recesses 13, the second recess 15 and the elongate guide slot 16 communicate with the space 11. The first recesses 13 are located between two fixing holes 14. The second recess 15 and the elongate guide slot 16 are located on two opposite sides of the handle 10.

A driving head 20 has a shank 22 extending therefrom which has a ratchet mechanism and an engaging portion. The engaging portion is engaged with an object. The shank 22 is inserted into the space 11 and pivotably connected to the handle 10 by a pin 30 extending through the first hole 12 and the second hole 21. The shank 22 is pivotable within the space 11. The shank 22 has a curved notch 23 defined in the distal end thereof.

A compression unit 40 is located in the space 11 and has a resilient member 41 and end piece 42. The resilient member 41 has a first end contacting the end piece 42 and the end piece 42 has a curved protrusion 421 extending from the center of its end face and the curved protrusion 421 is engaged with the curved notch 23. The resilient member 41 is indirectly in contact with the driving head 20.

An adjustment unit 50 is connected to the handle 10 to adjust the resilient member 41 to reach a pre-set value of torque of the driving head 20. The adjustment unit 50 comprises a fixing block 51, an outer tube 52, an adjustment rod 53 and a clip 54. The fixing block 51 is fixed in the space 11 and located on a side of the guide slot 16 and close to the end opposite to the driving head 20 of the handle 10. The fixing block 51 includes a threaded hole 510 defined centrally therethrough. The outer tube 52 has an open end so as to be rotatably mounted to the handle 10 and the other end of the outer tube 52 has a hexagonal hole 521 defined centrally therethrough. The adjustment rod 53 has a threaded section which is engaged with the threaded hole 510. A first piece 531 is connected to an end of the threaded section and contacts the second end of the resilient member 41. The adjustment rod 53 has a groove 532 defined in an outer surface thereof. The first piece 531 has a hexagonal block 533 extends from a distal end of the threaded section and is engaged with the hexagonal hole 521. The clip 54 is engaged with a distal end of the threaded section to connect the outer tube 52 to the adjustment rod 53. When the outer tube 52 is rotated relative to the handle 10, the fixing block 51 is stationary so that the outer tube 52 drives the adjustment rod 53 to move axially along the handle 10 to change the length of the resilient member 41 and move the second piece 61 to set the torque.

An index unit 60 is movable axially along with the length change of the resilient member 41 and has a second piece 61, a first index 62, a second index 63, at least one ring 64 and a clip 65. The second piece 61 has a positioning member 611 which is located in the guide slot 16. When the adjustment rod 53 is rotated and moved relative to the handle 10, the positioning member 611 and the second piece 61 are moved linearly along with the adjustment rod 53. The second piece 61, the first index 62 and the second index 63 are an integral part and movable longitudinally with a length change of the resilient member 41. The second index 63 is located above the first index 62, and the first index 62 is longer than the second index 63. The ring 64 has a through hole 641 defined centrally therethrough and the resilient member 41 is inserted into the through hole 641. There are two rings 64 and each has a slot 642 defined in the outer surface thereof so that the first index 62 is movably engaged with the slot 642. The clip 65 is engaged with the groove 532 of the adjustment rod 53 to restrict the second piece 61 to movably mount to the adjustment rod 53.

A display unit 70 is fixed to the fixing hole 14 of the handle 10 and has a display member 700, a calculation member 701 and four movement sensors 71. Each movement sensor 71 is located in the first recess 13. The movement sensors 71 detect the movement distance of the first index 62 and generates a signal which is calculated by the calculation member and transferred into a torque value displayed in the display member.

A scale member 80 is a transparent or semi-transparent member and has marks thereon. The scale member 80 located in the second recess 15 of the handle 10 and correspondent to the second index 63. The mark on the scale member 80 pointed by the second index 63 is the torque value.

When the first index 62 and the second index 63 respectively point the pre-set torque value of the display unit 70 and the scale member 80, the user may rotate the object by the driving head 20. When the output torque that the driving head 20 applies to the object reaches the pre-set torque value, the curved protrusion 421 is disengaged from the curved notch 23 to protect the object and the wrench.

Figure 7:
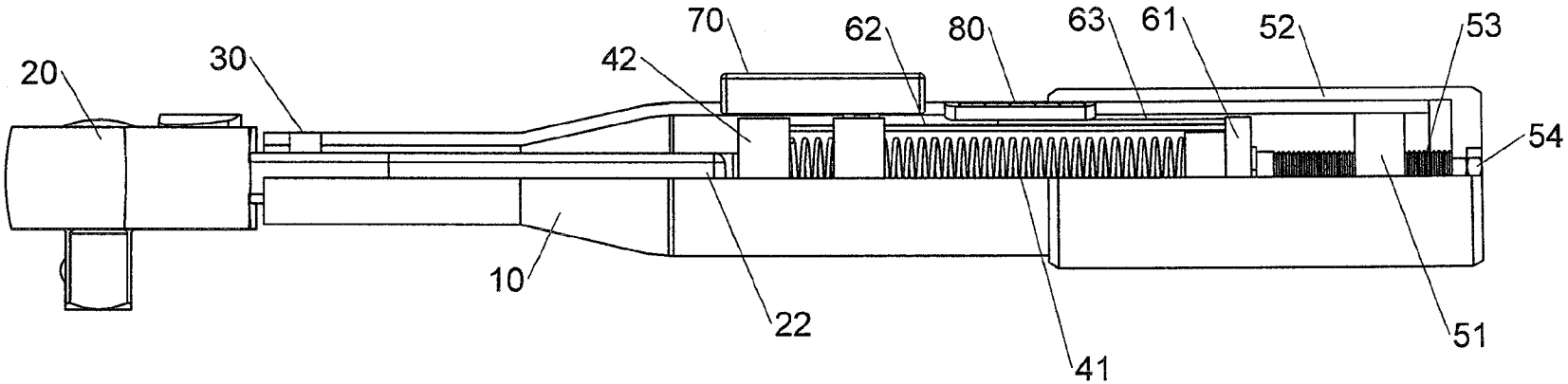
FIG. 7 shows the operational status of torque wrench.
Figure 8:
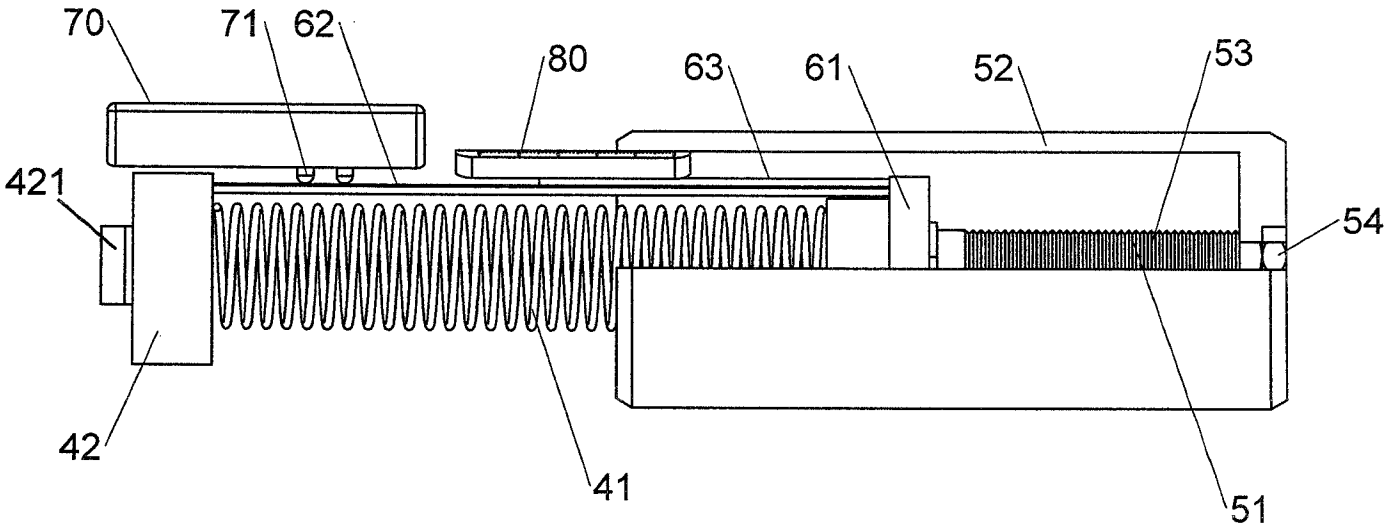
FIG. 8 shows the index unit in FIG. 7.

As shown in FIGS. 7 and 8, when the user rotates the outer tube 52 to rotate and move the adjustment rod 53, the first piece 531 compresses the resilient member 41 to provide torque to the wrench. The movement sensors 71 detect the movement of the first index 62 to show the torque value, and the second index 63 points the mark on the scale member 80 to show the torque value.

Figure 9:
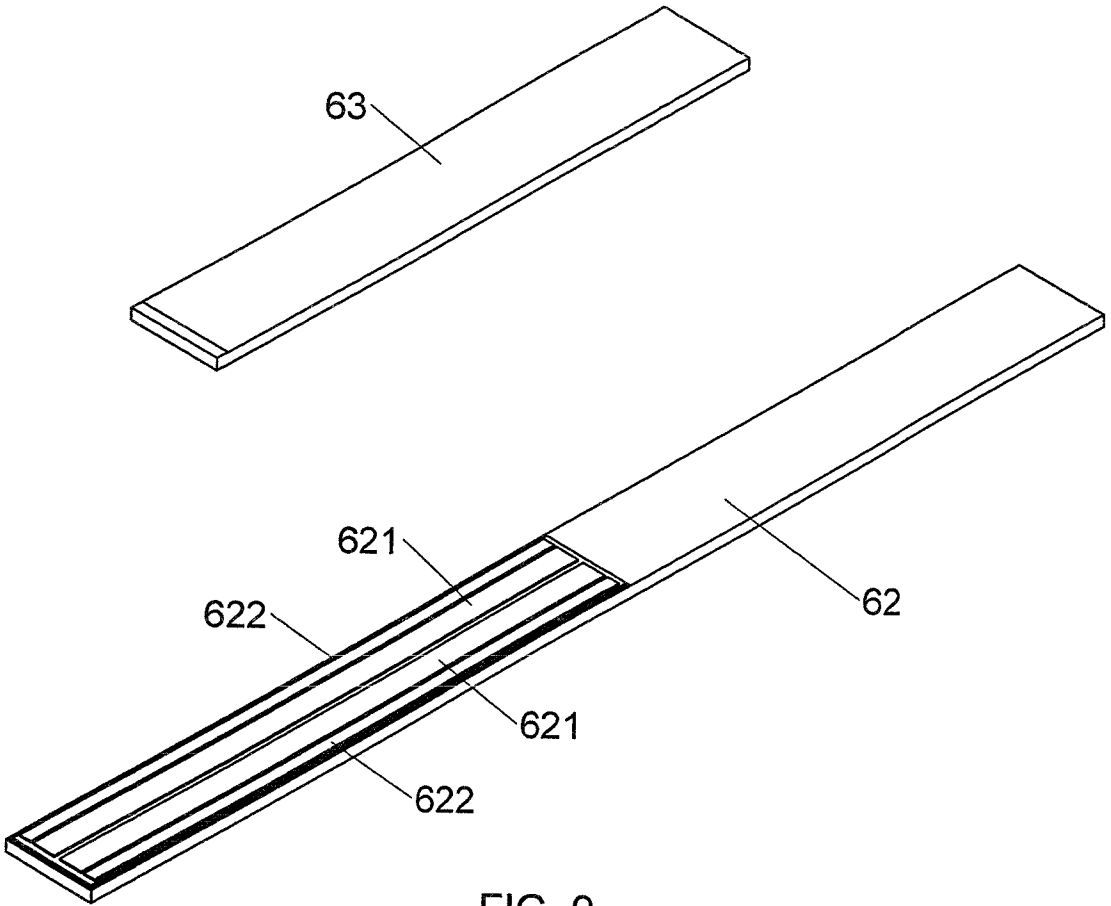
FIG. 9 shows the first index and second index of the index unit.

As shown in FIG. 9, the first index 62 has multiple parallel first lines 621 and second lines 622, the first and the second lines 621, 622 are detected by the movement sensors 71.

Figure 10:
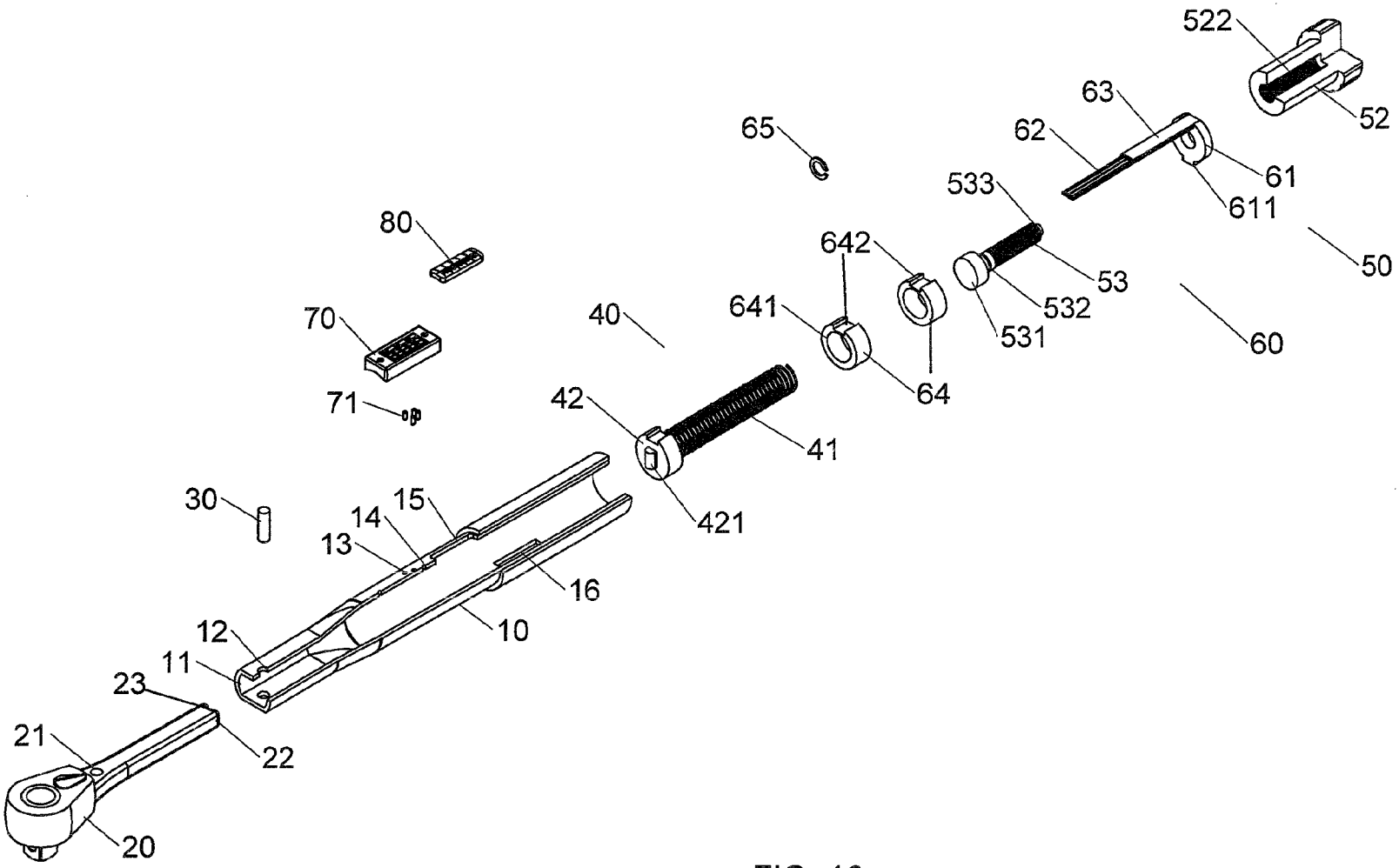
FIG. 10 is an exploded view to show the second embodiment of the torque wrench of the present invention.
Figure 11:
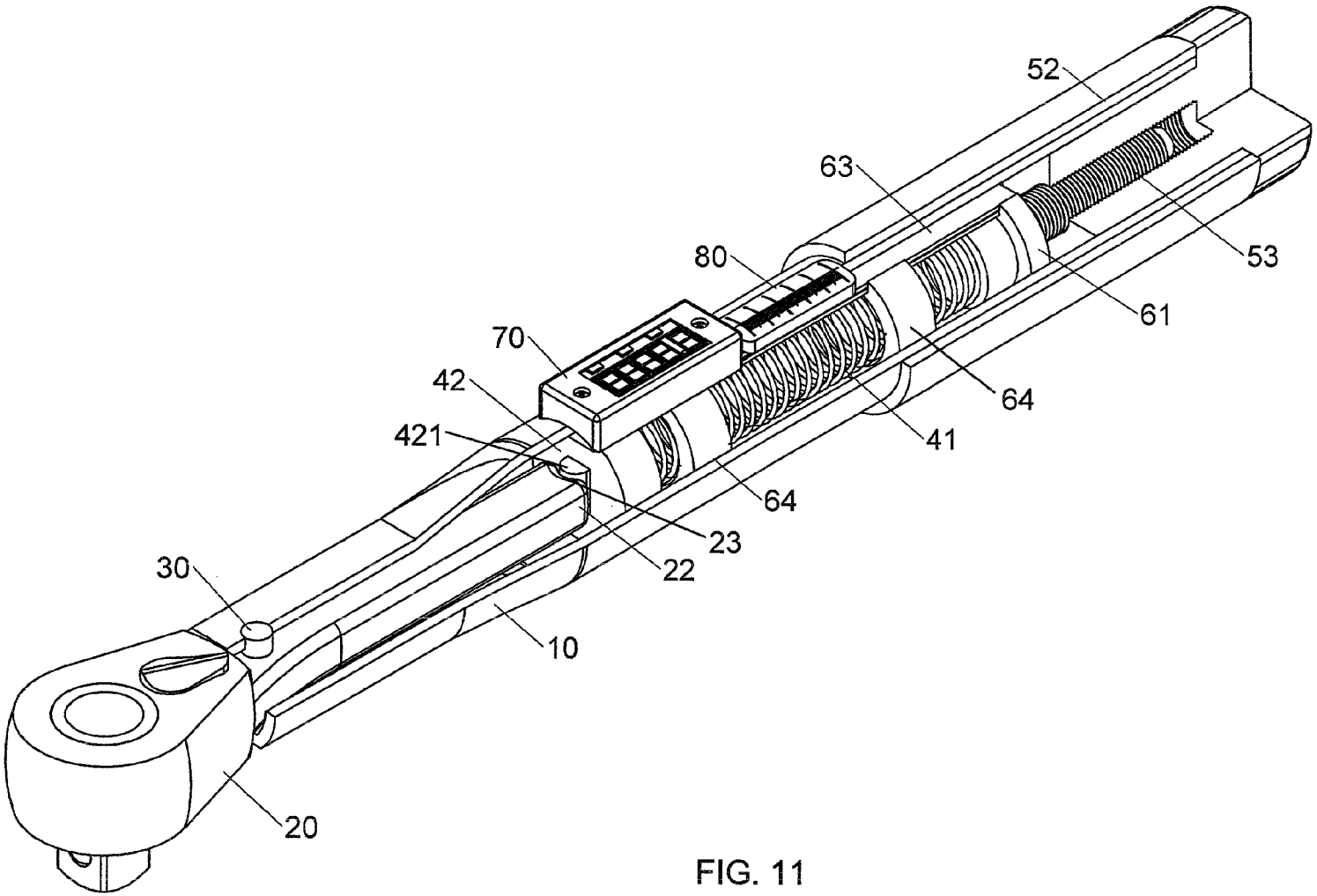
FIG. 11 is a perspective view to show the torque wrench of the present invention as shown in FIG. 10.
Figure 12:
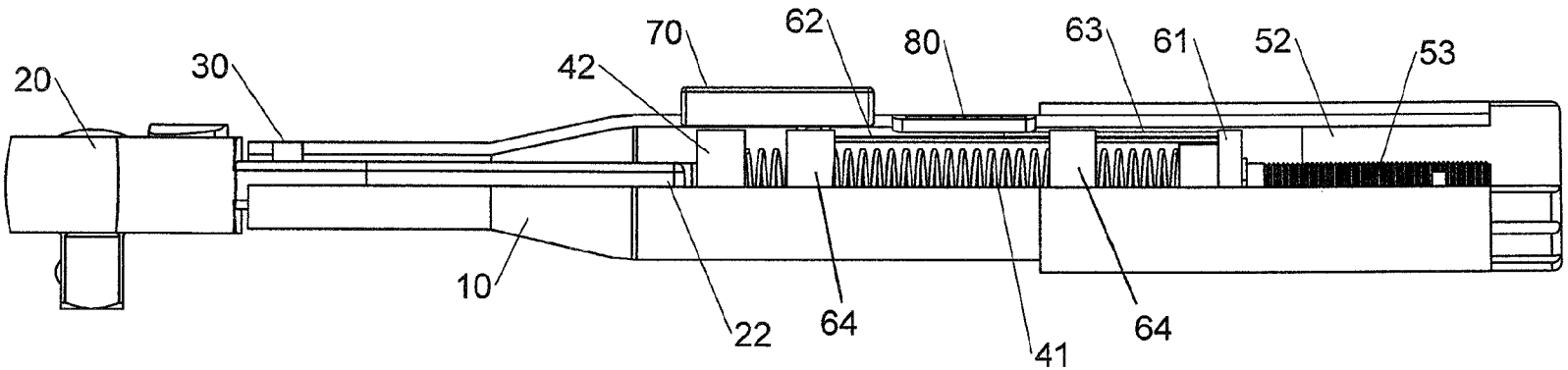
FIG. 12 is a side view of the torque wrench of the present invention as shown in FIG. 10.

As shown in FIGS. 10 to 12, the adjustment rod 53 can only be moved in the handle 10 and the outer tube 52 is rotatable connected to the end of the handle 10. The outer tube 52 is rotatably mounted to the handle 10 and has a threaded hole 522. The adjustment rod 53 has the threaded section engaged with the threaded hole 522. When the outer tube 52 is rotated relative to the handle 10, the adjustment rod 53 and the first piece 531 move axially to change the length of the resilient member 41 and move the second piece 61. The first and second indexes 62, 63 are moved along with the adjustment rod to show the torque value.

Figure 13:
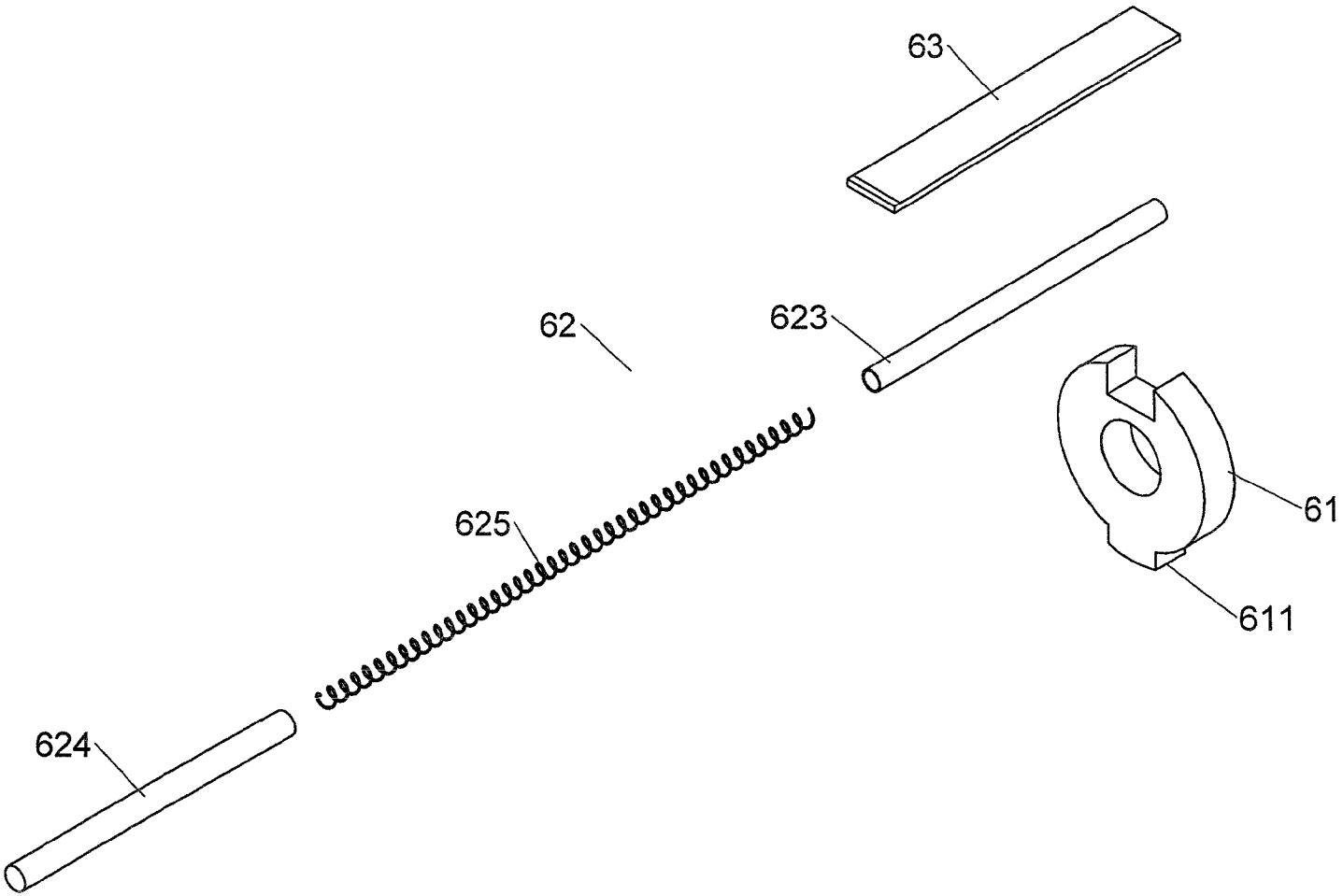
FIG. 13 shows the first index, the second index and the second piece of the third embodiment of the torque wrench of the present invention as shown in FIG. 10.
Figure 14:
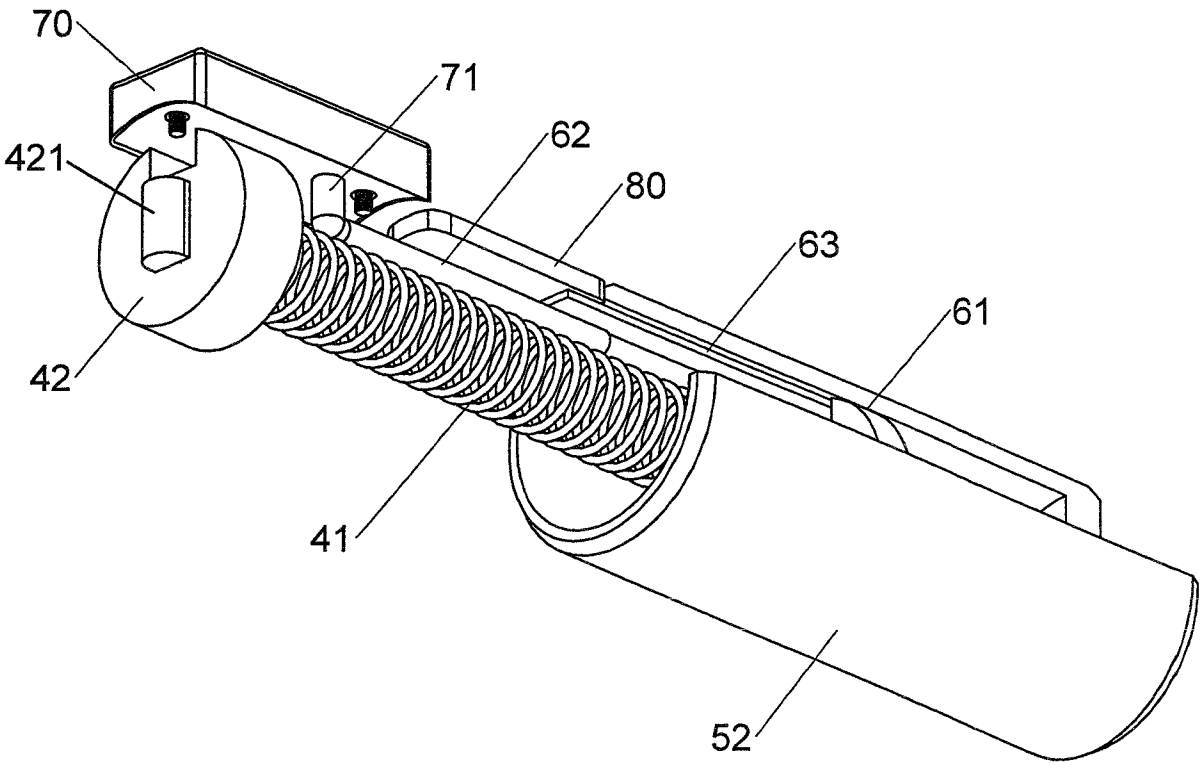
FIG. 14 is a perspective view to show a part of the third embodiment of the torque wrench of the present invention.
Figure 15:
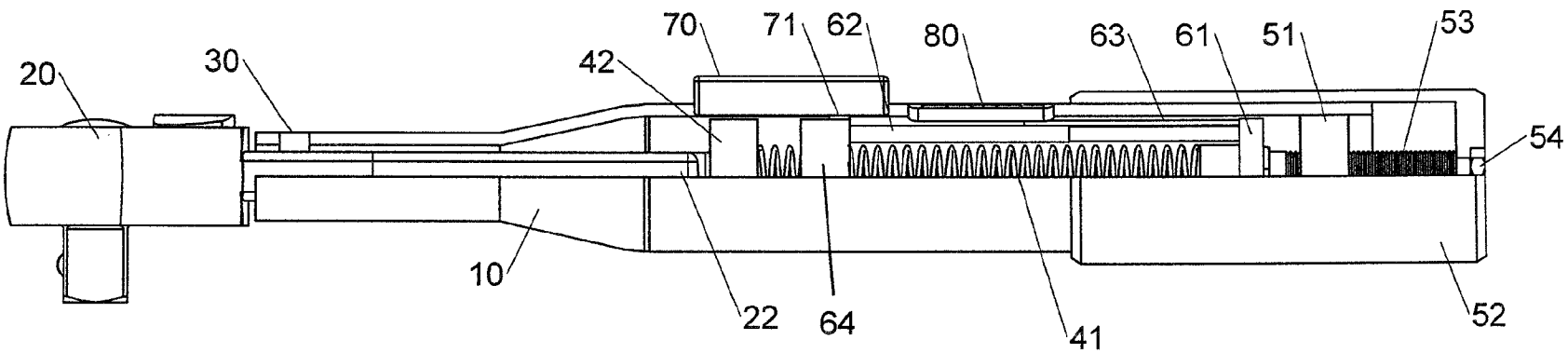
FIG. 15 is a side view of the third embodiment of the torque wrench of the present invention.

As shown in FIGS. 13 to 15, the first index 62 can be a retractable tube and includes a first tube 623, a second tube 624 and a resilient member 625. The first and second tubes 623, 624 are connected to each other, and the resilient member 625 contacts between the first and second tubes 623, 624 so that the length of the first and second tubes 623, 624 can be adjusted. The first tube 623 has an end fixed to the top of the second piece 61 and the second tube 624 has one end contacting the movement sensor 71 which detects the force from the first index 62 or the length of the first and second tubes 623, 624 to show the torque value on the display unit 70.

Figure 16:
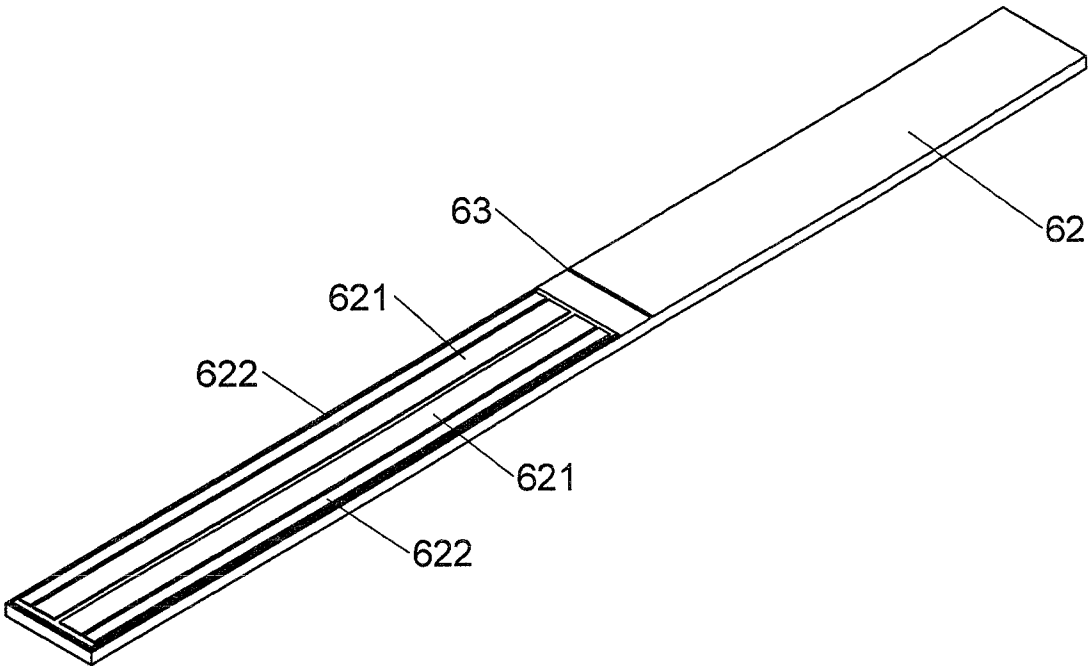
FIG. 16 shows the fourth embodiment of the torque wrench of the present invention.

As shown in FIG. 16, the fourth embodiment of the present invention shows that the first and second indexes 62, 63 are integrally connected to each other and the first index 62 has value marks which are matched with the marks on the scale member 80.

The torque wrench of the present invention can adjust the resilient member 41 by the adjustment unit to set the torque that disengages the curved protrusion 421 from the curved notch 23. The first index is moved with the movement of the adjustment rod 53 and the movement sensors 71 detect the movement distance to show the torque value. The index unit 60 includes the first index 62 and the second index 63, wherein the first index 62 shows the torque by digits and the second index 63 shows the torque by cooperation with the scale member 80. Therefore, the torque wrench includes both electronic and mechanical displays. In other words, if the display unit 70 fails, the mechanical display can show the torque.

While we have shown and described the embodiment in accordance with the present invention, it should be clear to those skilled in the art that further embodiments may be made without departing from the scope of the present invention.

What is claimed is:

1. A torque wrench comprising:

a hollow handle having a space defined therein;

a driving head having a shank extending therefrom which is inserted into the space, the shank pivotably connected to the handle by a pin and the shank being pivotable within the space;

a compression unit located in the space and having a resilient member and end piece, the resilient member having a first end contacting the end piece and the end piece contacting a distal end of the shank;

an adjustment unit connected to the handle to adjust the resilient member to reach a torque value of the driving head; the adjustment unit has an outer tube and an adjustment rod which is movably located in the handle, the outer tube is rotatably mounted to the handle and has a threaded hole, the adjustment rod has a threaded section which is engaged with the threaded hole, when the outer tube is rotated relative to the handle, the adjustment rod moves axially to change a length of the resilient member and move the second piece;

an index unit having a second piece, a first index and a second index, the second piece, the first index and the second index being an integral part and movable longitudinally with a length change of the resilient member;

a display unit fixed to the handle and having a display member, a calculation member and at least one movement sensor which detects a movement distance of the first index and generates a signal which is calculated by the calculation member and transferred into a torque value displayed in the display member, and a scale member being a transparent member and having marks thereon, the scale member located to the handle and corresponding to the second index, the mark being pointed by the second index being the torque value.

2. The torque wrench as claimed in claim 1, wherein there are four movement sensors and the first index has multiple parallel first lines and second lines, the first and the second lines are detected by the movement sensors.

3. The torque wrench as claimed in claim 1, wherein the handle has at least one ring fixed therein and the at least one ring has a slot defined in an outer surface thereof and the first index movably engaged with the slot, the resilient member extends through the at least one ring.

4. The torque wrench as claimed in claim 1, wherein the first index has value marks which are matched with the marks on the scale member.

5. The torque wrench as claimed in claim 1, wherein the second index is located above the first index.

6. The torque wrench as claimed in claim 1, wherein the handle includes a guide slot and the second piece is movably mounted to the adjustment rod, the second piece has a positioning member which is located in the guide slot.

7. The torque wrench as claimed in claim 6, wherein the adjustment rod has a groove defined in an outer surface thereof and a clip is engaged with the groove to contact the second piece so that the second piece is movably mounted to the adjustment rod.

8. A torque wrench comprising:

a hollow handle having a space defined therein;

a driving head having a shank extending therefrom which is inserted into the space, the shank pivotably connected to the handle by a pin and the shank being pivotable within the space a compression unit located in the space and having a resilient member and end piece, the resilient member having a first end contacting the end piece and the end piece contacting a distal end of the shank;

an adjustment unit connected to the handle to adjust the resilient member to reach a torque value of the driving head; the adjustment unit has a fixing block, an outer tube, an adjustment rod and a clip, the fixing block is fixed in the space and includes a threaded hole defined centrally therethrough, the outer tube is rotatably mounted to the handle and has an end with a hexagonal hole defined centrally therethrough, the adjustment rod has a threaded section which is engaged with the threaded hole, a first piece is connected to an end of the threaded section and contacts a second end of the resilient member, the first piece has a hexagonal block extends from a distal end of the threaded section and is engaged with the hexagonal hole, the clip is engaged with a distal end of the threaded section to connect the outer tube to the adjustment rod, when the outer tube is rotated relative to the handle, the adjustment rod moves axially to change a length of the resilient member and move the second piece;

an index unit having a second piece, a first index and a second index, the second piece, the first index and the second index being an integral part and movable longitudinally with a length change of the resilient member;

a display unit fixed to the handle and having a display member, a calculation member and at least one movement sensor which detects a movement distance of the first index and generates a signal which is calculated by the calculation member and transferred into a torque value displayed in the display member, and a scale member being a transparent member and having marks thereon, the scale member located to the handle and corresponding to the second index, the mark being pointed by the second index being the torque value.

9. The torque wrench as claimed in claim 8, wherein the handle includes a guide slot and the second piece is movably mounted to the adjustment rod, the second piece has a positioning member which is located in the guide slot.

10. The torque wrench as claimed in claim 9, wherein the adjustment rod has a groove defined in an outer surface thereof and a clip is engaged with the groove to contact the second piece so that the second piece is movably mounted to the adjustment rod.

11. A torque wrench comprising:

a hollow handle having a space defined therein; the handle has at least one ring fixed therein and the at least one ring has a slot defined in an outer surface thereof;

a driving head having a shank extending therefrom which is inserted into the space, the shank pivotably connected to the handle by a pin and the shank being pivotable within the space;

a compression unit located in the space and having a resilient member and end piece, the resilient member having a first end contacting the end piece and the end piece contacting a distal end of the shank;

an adjustment unit connected to the handle to adjust the resilient member to reach a torque value of the driving head;

an index unit having a second piece, a first index and a second index, the second piece, the first index and the second index being an integral part and movable longitudinally with a length change of the resilient member; the first index movably engaged with the slot of the at least one ring; the resilient member extends through the at least one ring a display unit fixed to the handle and having a display member, a calculation member and at least one movement sensor which detects a movement distance of the first index and generates a signal which is calculated by the calculation member and transferred into a torque value displayed in the display member, and a scale member being a transparent member and having marks thereon, the scale member located to the handle and corresponding to the second index, the mark being pointed by the second index being the torque value.

12. The torque wrench as claimed in claim 11, wherein there are four movement sensors and the first index has multiple parallel first lines and second lines, the first and the second lines are detected by the movement sensors.

13. The torque wrench as claimed in claim 11, wherein the first index has value marks which are matched with the marks on the scale member.

* * * * *